United States Patent [19]

Toshimitsu et al.

[11] Patent Number: 4,585,321

[45] Date of Patent: Apr. 29, 1986

[54] CORONA DISCHARGING APPARATUS

[75] Inventors: Kenshi Toshimitsu, Kawasaki; Tetsuya Sukegawa, Yokohama; Toshimasa Takano, Sagamihara, all of Japan

[73] Assignee: Kabushiki Kaisha Toshiba, Kawasaki, Japan

[21] Appl. No.: 696,101

[22] Filed: Jan. 29, 1985

[30] Foreign Application Priority Data

Oct. 30, 1984 [JP] Japan ..... 59-228520

[51] Int. Cl.[4] ..... G03G 15/02; H01T 19/00

[52] U.S. Cl. ..... 355/3 CH; 355/14 CH; 250/324

[58] Field of Search ..... 355/3 CH, 14 CH; 250/542, 324, 325, 326

[56] References Cited

U.S. PATENT DOCUMENTS

| | | | |
|---|---|---|---|
| 3,612,864 | 10/1971 | Tamai | 250/324 X |
| 3,813,549 | 5/1974 | DiStefano et al. | 250/324 |
| 4,053,770 | 10/1977 | Tanaka et al. | 250/324 |
| 4,110,614 | 8/1978 | Sarid et al. | 250/324 |
| 4,322,156 | 3/1982 | Kohyama | 250/324 X |
| 4,446,371 | 5/1984 | Cobb | 250/324 |

*Primary Examiner*—A. C. Prescott

*Attorney, Agent, or Firm*—Cushman, Darby & Cushman

[57] ABSTRACT

A corona discharging apparatus used in an electrophotographic process is provided with a conductive housing with an opening at one side, an electrode including a conductive linear member extending in one direction at the center of the opening, and a power source for applying a voltage between the housing and the electrode. The linear member consists of a core and a platinum layer covering the surface of the core. The core is formed of tungsten or molybdenum wire, and the core is coated with the platinum layer by cladding.

10 Claims, 5 Drawing Figures

FIG. 2
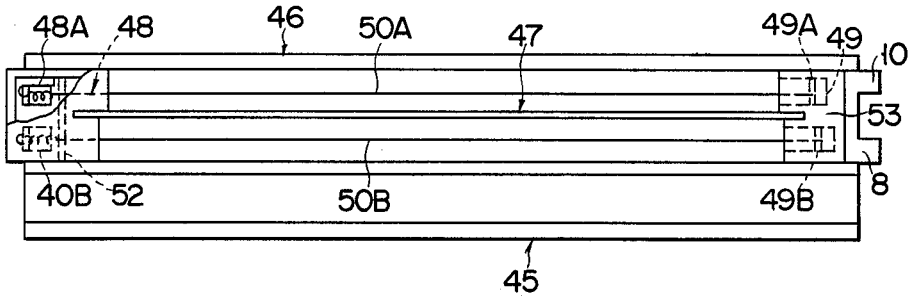
FIG. 3
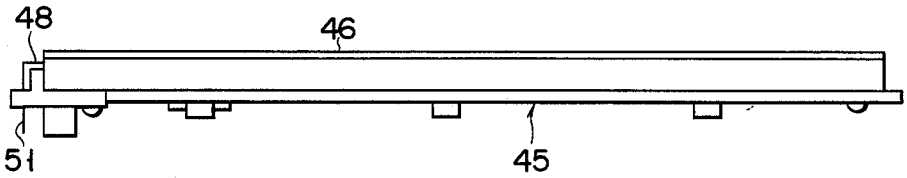
FIG. 5
FIG. 4
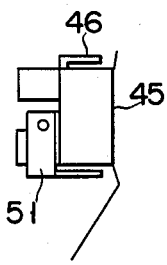
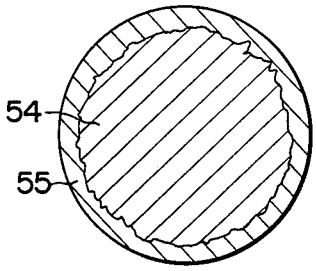

CORONA DISCHARGING APPARATUS

BACKGROUND OF THE INVENTION

The present invention relates to a corona discharging apparatus in which a linear electrode is stretched across a case and, more specifically, to a corona discharging apparatus used in an image forming apparatus such as an electrophotographic copying machine, facsimile, printer, etc., and adapted to charge or discharge an image bearer such as a photosensitive body.

In electrophotographic copying machines, corona discharging apparatuses are used for charging and discharging a photosensitive body on which an image is to be formed.

In the corona discharging apparatuses of this type, an opening is formed in one face of an aluminum case, and a linear discharge electrode faces the opening. The linear discharge electrode is generally formed of corona generating wire such as tungsten, molybdenum, platinum or other precious-metal wire.

The tungsten and molybdenum wires have advantages in being low in material cost and having high tensile strength and ductility. Thus, they provide a discharge electrode which can be stretched with high tensile force for higher discharge stability without unevenness in discharge.

As regards corona generation stability, the tungsten and molybdenum wires exhibit quite satisfactory corona generating capability in the initial stage. After a very short period of operation, however, the output or the distribution and amount of corona produced become uneven and unsteady, resulting in early electrical breakdown. Therefore, the tungsten and molybdenum wires have only a very short working life.

The cause of the aforesaid drawback lies in that the surface of the corona generating wire is susceptible to oxidation. Due to oxidation, corona is radiated unevenly and will deteriorate rapidly. Consequently, it is impossible to obtain a stable and uniform corona discharge, which results in indistinct images.

If the tungsten or molybdenum wire is used in a copying machine with a silicon heat roller, its surface will be soiled and corroded by silicon vapor or other products in the machine.

If the surface of the corona generating wire is thus soiled, it is cleaned by using cotton or the like to restore it to its original condition. However, the tungsten and molybdenum wires cannot enjoy a satisfactory cleaning effect for improved life performance.

Unlike tungsten and molybdenum wires, platinum wire, which has high chemical stability, exhibits uniform and stable discharging capability. Even if its surface is soiled by any products in the copying machine, the platinum wire can easily be cleaned by means of cotton or the like. Periodic cleaning will ensure the platen wire of a very long working life.

However, the platinum wire is expensive. Also, it is much lower in tensile strength than tungsten or molybdenum wire and is highly ductile, so that it cannot be stretched with great tensile force. Namely, an increase of tensile force will result in deformation of the wire material. For example, if a high AC voltage is applied to the discharge electrode, the electrode will vibrate, degrading discharge stability.

SUMMARY OF THE INVENTION

The present invention is contrived in consideration of these circumstances, and is intended to provide a corona discharging apparatus with a longer life and capable of producing a uniform and stable discharge and of producing clear images even after prolonged use.

In order to achieve the above object, there is provided a corona discharging apparatus in which a voltage is applied to a linear discharge electrode for corona discharge, the discharge electrode consisting of a conductive linear member and a platinum layer covering the surface of the linear member.

The corona discharging apparatus of this construction can produce a uniform, stable discharge effect for a long time.

BRIEF DESCRIPTION OF THE DRAWINGS

FIGS. 2, 3 and 4 are a plan view, a front view, and a side view, respectively, of the corona discharging apparatus as the principal part of the copying machine shown in FIG. 1; and FIG. 5 is an enlarged sectional view of a discharge electrode of the corona discharging apparatus.

DETAILED DESCRIPTION OF THE PREFERRED EMBODIMENT

Figure 1:
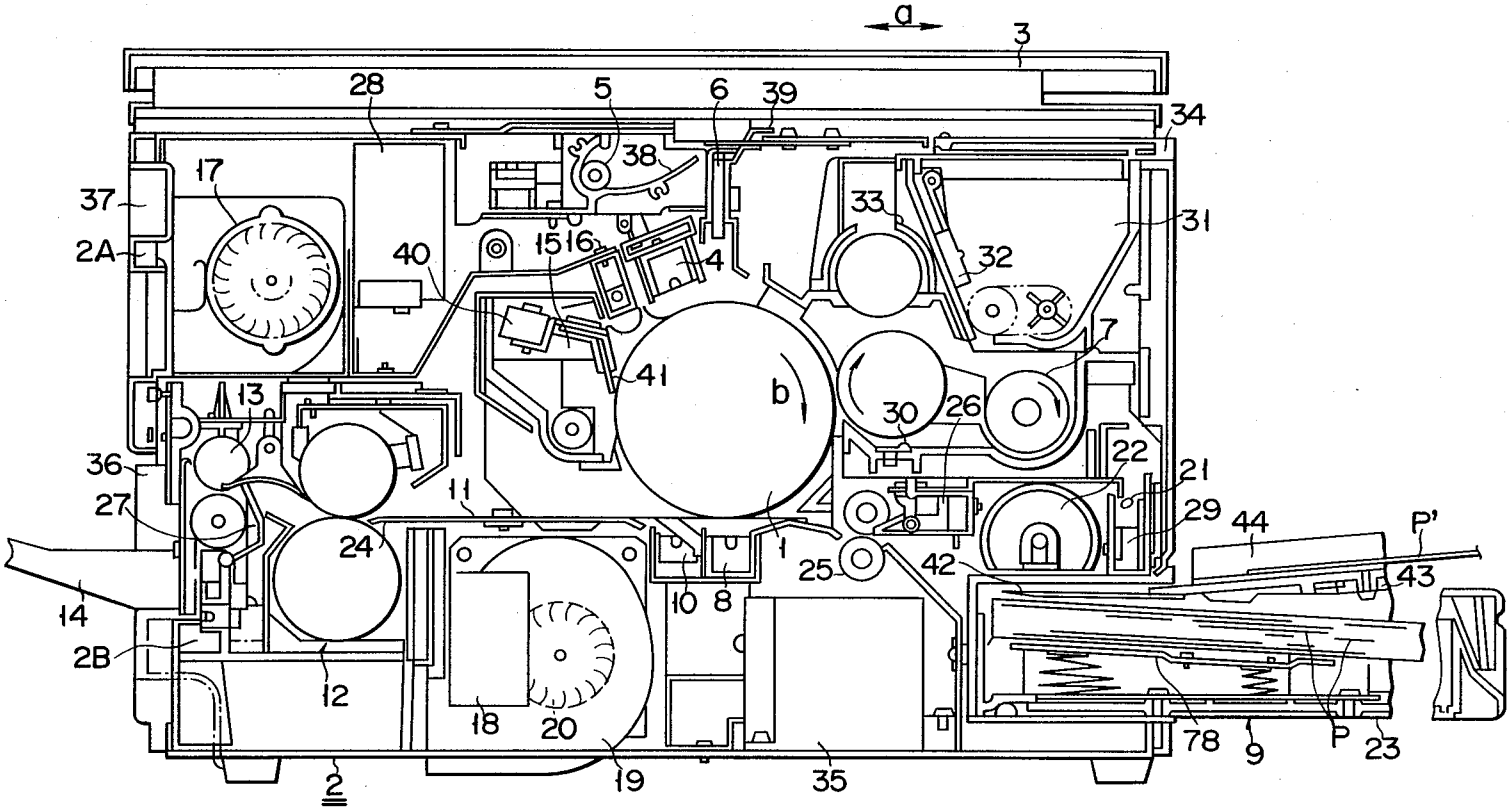
FIG. 1 is a sectional view schematically showing an electrophotographic copying machine incorporating one embodiment of a corona discharging apparatus according to the present invention.

One embodiment of a corona discharging apparatus according to the present invention applied to an electrophotographic copying machine will now be described in detail with reference to the accompanying drawings.

FIG. 1 is a sectional view schematically showing an example of this invention as adapted to an electrophotographic copying machine.

Referring now to FIG. 1, the internal mechanism of the electrophotographic copying machine will be described. In FIG. 1, reference numeral 1 denotes a drum-shaped photosensitive body which is disposed in the substantially central portion of a housing 2 of the copying machine. An original table 3 capable of reciprocating in directions indicated by arrow a is set on the top of the machine housing 1. The photosensitive body 1 is rotated in the clockwise direction indicated by arrow b by a drive mechanism (not shown), synchronized with the reciprocation of the original table 3. The photosensitive body 1 is surrounded by a charger 4 as a corona discharging apparatus, a convergent light transmitter 6, a developing unit 7, a transfer charger 8, a cleaning unit 15, and a discharge lamp 16, which are arranged in succession in the rotating direction of the photosensitive body 1. The charger 4 serves to uniformly charge the surface of the photosensitive body 1. A reflected light from an original image uniformly irradiated by an exposure lamp 5 is projected on the charged surface of the photosensitive body 1 by the convergent light transmitter 6, forming on the photosensitive body 1 an electrostatic latent image corresponding to the original image. The electrostatic latent image formed in this manner is developed into a toner image by the developing unit 7 using toner as a developer. Then, the toner image is fed to a position facing the transfer charger 8 constituting one part of a corona discharging apparatus.

A sheet P (P') supplied automatically or manually is fed into the machine housing 2 by a paper feeder 9, and the toner image previously formed on the photosensitive body 1 is transferred to the surface of the sheet P (P') by the transfer charger 8. Then, the sheet P (P') is separated from the photosensitive body 1 by a separation charger 10 constituting the other part of the corona discharging apparatus which uses AC corona discharge. The separated sheet P (P') is passed through a conveying path 11 to reach a fixing unit 12, where the toner image is fused and fixed on the sheet P (P'). Thereafter, the sheet P (P') is discharged into a removable tray 14 by an exit roller pair 13.

After the transfer of the toner image to the surface of the sheet P (P'), the toner remaining on the photosensitive body 1 is cleared away by the cleaning unit 15. The potential on the photosensitive body 1 is dropped below a predetermined level by the discharge lamp 16 for the next copying operation.

Numeral 17 designates a fan as a cooling unit. The fan 17 serves to remove heat produced by the exposure lamp 5 and the fixing unit 12 as heat generating parts from the machine housing 2, thereby cooling the interior of the machine housing 2. Also, an exhaust fan 20 for cooling a power supply unit 18 and the like is attached to a main motor 19.

Inside the machine housing 2, upper and lower frames (not shown) are swingably mounted on a shaft 21 at one end portion. Thus, the two frames can be swung apart at a desired angle of, e.g., 30 degrees to each other so that the inside of the machine housing 2 is exposed. The photosensitive body 1, the charger 4, the convergent light transmitter 6, the exposure lamp 5, the developing unit 7, the cleaning unit 15, and the discharge lamp 16 are provided on the upper frame. The upper frame also has the cooling fan 17, a paper supply roller 22 of the paper feeder 9, and the original table 3. The upper frame and those elements mounted thereon constitute an upper unit 2A. A paper cassette 23, the transfer charger 8, the separation charger 10, the conveying path 11, a guide plate 24 forming the conveying path 11, the fixing unit 12, the exit roller pair 13, the tray 14, the main motor 19, and the power supply unit 18 are provided on the lower frame. The lower frame and those elements mounted thereon constitute a lower unit 2B. After the front cover (not shown) of the machine housing 2 is removed in a swinging manner, the upper and lower units 2A and 2B can be separated or joined together along the sheet conveying path 11 through the operation of a housing lock mechanism (not shown), swung around the shaft 21. Thus, any sheets P (P') jammed on the conveying path 11 can be removed with ease.

In FIG. 1, numeral 25 designates an aligning roller pair which corrects the tilt of the leading edge of the sheet P or P' fed automatically or manually from the paper cassette 23, and delivers the sheet P (P') to the region between the transfer charger 8 and the photosensitive body 1 in time with the formation of the toner image on the photosensitive body 1. Numeral 26 denotes a manual feed detection switch disposed next to the aligning roller pair 25.

In FIG. 1, there are also shown an exit switch 27, a total counter 28, a paper-empty switch 29 for indicating that the paper cassette 23 is empty, a doctor 30 for regulating the thickness of a developer layer on the developing unit 7, a toner hopper 31, a toner-empty detection switch 32, a toner concentration detector 33, and a hopper cover 34. The original table 3 cannot move unless the hopper 31 is closed by the cover 34.

A high-voltage transformer 35, a de-electrification brush 36, a grip 37 formed at the exhaust port section of the fan 17, a reflector 38 enclosing the back of the exposure lamp 5, and an auxiliary reflector 39 are also shown.

Numeral 40 designates a blade solenoid which causes a cleaning blade 41 of the cleaning unit 15 to touch and move back from the photosensitive body 1.

The reflector 38, the auxiliary reflector 39, and the convergent light transmitter 6 are assembled into a single unit.

Those elements designated by reference numerals 27 to 41 are generally known and constitute none of the features or advantages of the present invention. Therefore, a detailed description of the elements 27 to 41 is omitted.

The paper feeder 9 on the lower right side of the machine housing 2 includes the paper cassette 23, a cassette cover 43 covering the whole top surface of the paper cassette 23 except a delivery opening 42, a sheet-bypass guide 44 formed on the cassette cover 43, and the paper supply roller 22 for delivering the sheets P from the paper cassette 23. The paper supply roller 22 is a semicircular cut roller which delivers the sheets P one by one from the paper cassette 23 toward the aligning roller pair 25 by rotating clockwise from the position shown in FIG. 1.

When the paper supply roller 22 is in the position shown in FIG. 1, the sheet P' manually fed through the sheet-bypass guide 44 is inserted into the position adjacent to the aligning roller pair 25, guided by the cut face of the paper supply roller 22. During the manual paper feed, the paper supply roller 22 is locked to the position of FIG. 1.

The transfer charger 8 and the separation charger 10 constituting the corona discharging apparatus used in the electrophotographic copying machine shown in FIG. 1 will now be described in detail.

FIGS. 2, 3 and 4 are a plan view, a front view, and a side view, respectively, showing a corona discharging apparatus 45 in which the transfer charger 8 and the separation charger 10 shown in FIG. 1 are formed integral. In FIGS. 2 to 4, numeral 46 designates a case formed of, e.g., aluminum. The case 46 is opened on its side facing the photosensitive body 1. The case 46 is removably fitted with a diaphragm 47, which extends in the longitudinal direction of the case 46 to divide the inside space of the case 46 in two. The case 46 and the diaphragm 47 are securely, electrically connected so as to avoid extraordinary discharge between them. Also, the case 46 is fitted at one end portion with a power supply terminal unit 48 which includes a first feeding terminal, e.g., an AC power supply terminal 48A, connected to an output line of an AC power supply, and a second feeding terminal, e.g., a DC power supply terminal 48B, connected to an output line of a DC power supply. A receiving terminal unit 49 including first and second receiving terminals 49A and 49B is attached to the other end portion of the case 46.

A first discharge electrode 50A formed of charger wire is stretched between the AC power supply terminal 48A and the first receiving terminal 49A, located on one space side of the case 46 divided by the diaphragm 47. Likewise, a second discharge electrode 50B is stretched between the DC power supply terminal 48B and the second receiving terminal 49B, located on the other space side of the case 46 divided by the diaphragm 47. That portion of the corona discharging apparatus 45 on the side of the first discharge electrode 50A is used as the separation charger 10, and that portion of the apparatus 45 on the side of the discharge electrode 50B as the transfer charger 8. A holder 51 is attached to the case 46 under the feeding terminal unit 48, whereby the corona discharging apparatus 45 is mounted on the frame of the electrophotographic copying machine beside the photosensitive body 1. The holder 51 and the case 46 are provided with notch portions at least in those regions near the AC power supply terminal 48A. Thus, even if a sufficient distance for insulation cannot be secured between the AC power supply terminal 48A and the case 46, it is possible to prevent production of corona and extraordinary arc between them.

In FIG. 2, numerals 52 and 53 designate insulating plates which cover the exposed portions of the feeding terminal unit 48 and the receiving terminal unit 49, respectively.

High AC and DC voltages from the high-voltage transformer 35 (see FIG. 1) are applied to the discharge electrodes 50A and 50B through the feeding terminals 48A and 48B of the feeding terminal unit 48, respectively. The applied voltages preferably range from 4 to 8 kV.

The case 46 is grounded through the frame of the copying machine.

As shown in FIG. 5, each of the discharge electrodes 50A and 50B is formed of a linear member 54 as a core and a platinum layer 55 on the surface of the linear member 54.

Preferably, the linear member 54 is formed of a conductive wire material with a diameter of approximately 40 to 100 microns, e.g., tungsten or molybdenum wire.

The thickness of the platinum layer 55 covering the surface of the linear member 54 ranges from approximately 5 to 40 microns.

In corona discharging apparatuses used in image forming apparatuses such as electronic copying machines, the discharge wires are required to have lower cost, higher breaking strength, ductility, chemical surface stability, and greater resistance to change of the corona discharge over time. As described before, however, the prior art discharge wires, whether tungsten or platinum, have both merits and demerits and are not practical. According to the present invention, on the other hand, the discharge electrodes are each formed of the linear member 54 as a core and the platinum layer 55 covering the surface of the linear member 54. The correlations between the aforesaid characteristics of the platinum wire (Pt wire), the tungsten wire (W wire), and the laminate-structure wire (L wire) of the present invention are tabulated as follows.

TABLE

| | |
|---|---|
| Cost: | W wire < L wire < Pt wire |
| Breaking Strength: | W wire > L wire > Pt wire |
| Ductility: | W wire < L wire < Pt wire |
| Chemical Surface Stability: | Pt wire ≅ L wire > W wire |
| Change in Corona Discharge Over Time: | Pr wire ≅ L wire > W wire |

(Note)
Molybdenum wire resembles tungsten wire in these characteristics.

Thus, the use of the tungsten-platinum wire of the invention leads to the elimination of the disadvantages of the conventional tungsten or platinum wire in any of the items in the above table.

In the present embodiment, moreover, the linear are member 54 is coated with the platinum layer 55 by cladding to ensure stronger adhesion.

In the cladding process, a sleeve-shaped platinum material is put on and pressure-bonded to a linear core material, and the resultant structure is then drawn by heating. Thus, a laminate-coated wire is obtained. In this embodiment, a platinum sleeve with a predetermined thickness and a length of 1.8 m is put on and pressure-bonded to a smooth-surface tungsten core material with a diameter of 3.2 mm and a length of 1.8 m to form a base structure. The base structure is drawn to a length of about 900 m and heated to a temperature of about 1,000° C. by means of a burner. Thus, the discharge electrodes 50A and 50B are formed.

As seen from the sectional view of FIG. 5, the platinum layer 55 formed by cladding has a very fine structure, eating into the surface portion of the linear member 54 for close adhesion.

It was revealed that the discharge electrodes of this construction can maintain a stable laminate structure for a long time without separation of the platinum layer 55 from the linear member 54 or swelling of the platinum layer 55.

Thus, the discharge electrodes can produce a lasting, uniform and stable discharge effect and provide positive clear images without unevenness.

Although an illustrative embodiment of the present invention has been described in detail herein, the corona discharging apparatus of the invention is not limited to the embodiment, and may also be applied to any other image forming apparatuses. Further, the linear member may be formed of any conductive material other than the tungsten or molybdenum wire.

According to the above described embodiment, the discharge electrodes have a laminate structure consisting of a conductive linear member and a platium layer thereon. Thus, the tensile strength and surface stability of the electrodes are provided by the linear member and the platinum layer, respectively. Moreover, the platinum layer is applied by cladding, so that it can satisfactorily cover and adhere to the linear member, ensuring a lastingly stable and uniform discharge effect without separation or swelling. Thus, it is possible to obtain lastingly clear, high-quality images without unevenness.

What is claimed is:

1. A corona discharging apparatus used in an electrophotographic process, comprising:

a conductive case;

an electrode operatively associated with said conductive case and extending in one direction at a predetermined distance from said conductive case, said electrode including a linear member having a core and a platinum layer covering the surface of the core; and power supply means connected to said electrode for applying a voltage between the case and the electrode.

2. The corona discharging apparatus according to claim 1, wherein said core is formed of tungsten wire.

3. The corona discharging apparatus according to claim 2, wherein said tungsten core is coated with the platinum layer by cladding.

4. The corona discharging apparatus according to claim 1, wherein said core is formed of molybdenum wire.

5. The corona discharging apparatus according to claim 4, wherein said molybdenum core is coated with the platinum layer by cladding.

6. The corona discharging apparatus according to claim 1, wherein said core is coated with the platinum layer by cladding.

7. The corona discharging apparatus according to claim 1, wherein said power supply means supplies an AC voltage.

8. The corona discharging apparatus according to claim 7, wherein said electrode has an outer diameter of 40 to 100 microns, and said AC voltage is set within a range of 4 kv to 8 kv.

9. The corona discharging apparatus according to claim 1, wherein said power supply means supplies an DC voltage.

10. The corona discharging apparatus according to claim 9, wherein said electrode has an outer diameter of 40 to 100 microns, and said DC voltage is set within a range of 4 kv to 8 kv.

* * * * *